United States Patent [19]

Robbins, III et al.

[11] Patent Number: 4,925,055

[45] Date of Patent: May 15, 1990

[54] CONTAINER WITH UNITARY BLADDER AND ASSOCIATED DISPENSER CAP

[75] Inventors: Edward S. Robbins, III, 459 N. Court, Florence, Ala. 35630; Theodore J. Onocki, Florence, Ala.

[73] Assignee: Edward S. Robbins, III, Florence, Ala.

[21] Appl. No.: 276,636

[22] Filed: Nov. 28, 1988

Related U.S. Application Data

[63] Continuation-in-part of Ser. No. 163,900, Mar. 4, 1988, Pat. No. 4,805,799.

[51] Int. Cl.[5] ..... B65D 25/16

[52] U.S. Cl. ..... 220/403; 215/1 C

[58] Field of Search ..... 220/403, 256; 215/11.1, 215/11.3, 1 C

[56] References Cited

U.S. PATENT DOCUMENTS

| | | | |
|---|---|---|---|
| 2,816,548 | 12/1957 | Tupper | 128/252 |
| 2,876,113 | 3/1959 | Barton | 220/404 X |
| 3,773,233 | 11/1973 | Souza | 222/490 |
| 3,784,039 | 1/1974 | Marco | 215/1 C X |
| 3,825,157 | 7/1974 | Herzig | 222/212 |
| 4,561,570 | 12/1985 | Zulauf et al. | 222/153 |
| 4,739,906 | 4/1988 | LoTurco | 222/153 |
| 4,749,108 | 6/1988 | Dornsbusch | 222/212 |
| 4,805,799 | 2/1989 | Robbins, III | 220/403 |

*Primary Examiner*—Steven M. Pollard

*Attorney, Agent, or Firm*—Nixon & Vanderhye

[57] ABSTRACT

A container includes a substantially rigid upper container segment, a flexible bladder integral with, and depending from, the upper container segment, and a lower substantially rigid container segment attached to the upper container segment so that the flexible bladder is housed therein. The upper container segment presents a smooth exterior continuation of the lower container segment so that the two segments visually appear to be formed in a unitary manner. A foldable hanger may be provided integrally on the bottom wall of the container so as to facilitate the container's supported inversion. In one embodiment, the bladder is spaced from the container bottom wall so as to establish a sub-container therebetween. A self-closing dispensing cap is provided which includes a pair of resilient, flexible sealing lips which are defined in part by an elongated discharge slit. An overcap is also provided which includes additional sealing means for engaging the sealing lips when the overcap is in a closed position.

32 Claims, 4 Drawing Sheets

FIG. 1
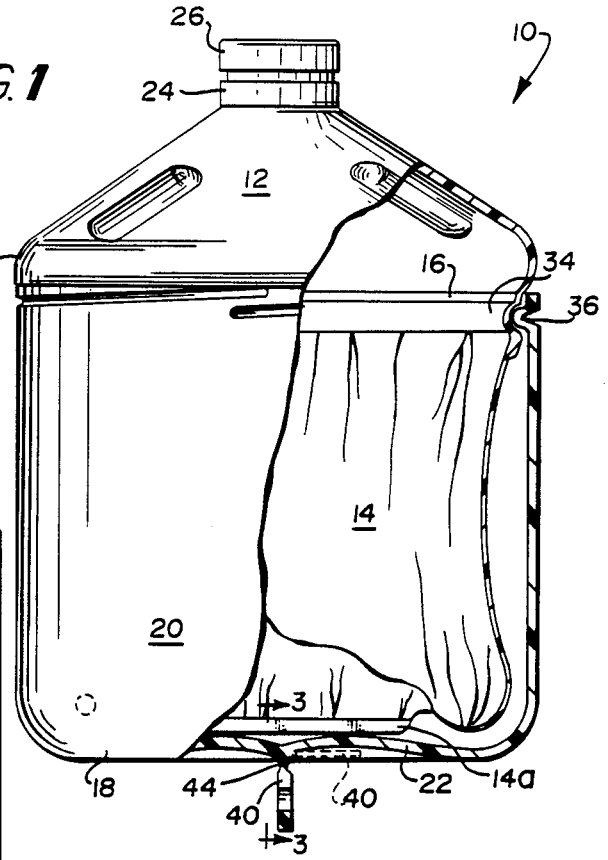
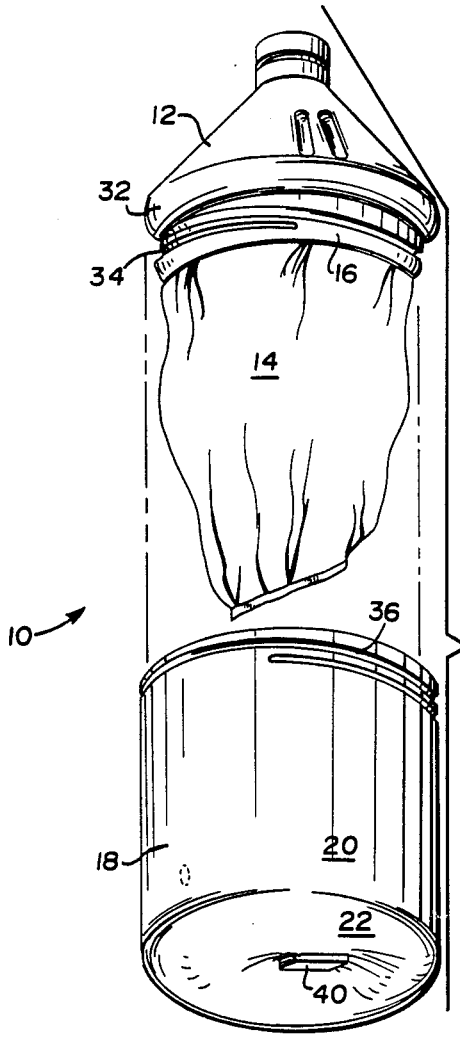
FIG. 2

CONTAINER WITH UNITARY BLADDER AND ASSOCIATED DISPENSER CAP

RELATED APPLICATION

This application is a continuation-in-part of application Ser. No. 07/163,900, filed Mar. 4, 1988 and now allowed, U.S. Pat. No. 4,805,799.

FIELD OF THE INVENTION

This application relates to the field of containers generally. In its preferred embodiment, the invention more specifically relates to containers having unitary or integral bladders, liners or the like. The application also relates to a self-closable dispenser cap for use with containers in general and with bladder-type containers in particular.

BACKGROUND AND SUMMARY OF THE INVENTION

Many uses actually and potentially exist for containers having internal bladders (hereafter simply called "bladder-type containers" for ease of reference). Bladder-type containers and associated closures or dispensing caps may thus be useful to transport, store and/or dispense a variety of liquid or solid materials for commercial, industrial and/or residential end-uses. For example, bladder-type containers could be used in hospital environments as a replacement for intravenous bags, and in other environments as a convenient means to ship, store and dispense potable liquids (e.g., wine or other spirits). Those in this art will undoubtedly realize other possible beneficial uses for such bladder-type containers and associated closures or caps.

INFORMATION DISCLOSURE STATEMENT

Various proposals exist in the art to provide a flexible bladder within a substantially rigid walled container, attention being directed specifically to U.S. Pat. Nos. 3,163,544 to Valyi; 4,560,085 to Vom Hofe et al; 3,179,323 to Miller; 2,352,503 to Walton; 2,338,604 to Silveyra; 3,039,648 to Busch; 3,643,854 to Holmes; 3,918,605 to Butler; and 3,765,574 to Urquiza.

Valyi '544 and Vom Hofe et al '085 each disclose a bladder container in which the bladder includes a "thickened" upper portion which is adapted to being connected to an external container in which the bladder is housed. These thickened portions of Valyi '544 and Vom Hofe et al '085 do not extend upwardly from the container and thus do not define, collectively with the bladder, any meaningful volume. Thus, these thickened portions appear to be present merely for the purpose of defining an access opening to the bladder and for connecting the bladder to an upper rim of the container.

Miller '323, Walton '503, and Silveyra '604 suggest that a flexible bladder (which may be closed by means of a suitable cap—see, Miller '323 and Silveyra '604), is merely housed within an otherwise rigid external container.

Busch '648 suggests that a bottle, which may be formed from a flexible rubber (or rubber-like material) or flexible plastic, could have its upper portion formed into the shape of a cone which terminates in a neck. Threads are formed on the neck so that a cap having matching threads may be coupled to the neck thereby closing the bottle. The bottle is housed within a metal sheath and is held therein by a plurality of inwardly bent finger structures.

Holmes '854 discloses a container for paints and other like liquids. The container of Holmes '854 includes a carton erected from a collapsible tubular blank, a rectangular lid which is secured to the top of the carton, and a flexible bag having an opening which is peripherally sealed to a skirt depending from the lid within the carton.

A combination container with disposable closure and liner assembly is disclosed in Butler '605 as having a closure element having a main body portion against which a neck of a liner is secured by a peripherally positioned clamp. The liner and main body portion are thus not integral with one another.

An open-ended flexible liner having a flanged collar ring may be inserted into a rigid external container according to Urquiza '574. An aperture is provided in the bottom wall of the external container so that, after the bag is inserted into the external container and filled, its open end may be heat-sealed.

There are also known in the art various proposals for self-closing caps or closures for use with containers, and in this regard, attention is drawn to U.S. Pat. Nos. 4,749,108 to Dornsbusch; 4,739,906 to LoTurco; 4,561,570 to Zulauf et al; 3,825,157 to Herzig; 3,773,233 to Souza; and 2,816,548 to Tupper.

Both Souza '233 and Herzig '157 disclose automatic closures for squeezable containers for Viscous material. In each case, the closure is formed merely by resilient, flattened lip portions which open under pressure and close upon release of pressure.

In LoTurco '906, a plastic squeeze bottle is provided at its discharge end with an integral stem having a plurality of dispensing apertures spaced about the base of the stem. An over cap assembly, including a retaining ring and a cap is applied to the bottle, the retaining ring having a dispensing stem including an aperture disposed over the bottle stem. Engagement of the surfaces of the respective stems normally preclude escape of the container contents, in conjunction with a protuberance formed on the interior of the cap. When the cap is disengaged, and under squeeze pressure applied to the bottle, the surfaces of respective stems are forced to separate, allowing the contents to be discharged through the apertures in the base of the integral stem and the aperture in the retaining ring. The seal is reestablished upon the cessation of the applied pressure.

Zulauf '570 discloses a closure similar to that of LoTurco '906.

Dornsbusch '108 discloses a flexible storage and dispensing package which includes a container having a neck portion and a dispensing valve. The valve is formed with a diaphragm provided with an elongated discharge slit. Manual pressure applied to the container is said to force the container contents through the slit, and after the pressure has been removed, the slit automatically closes.

Tupper '548 discloses a resilient sipper-type seal for discharging fluid contents from vessels or containers. The seal normally remains closed to prevent leakage of the fluid, but is forced open by the user when sipping the contents from the container.

SUMMARY OF THE PRESENT INVENTION

According to the present invention, a container is provided which is formed by means of a substantially rigid external container having upper and lower sections coupled to one another (as by mated threaded engagement, heat sealing, adhesive connection, and the like). A flexible liner or bladder is integral with the upper section of the container so that it dependently extends into the interior of, and is housed by, the lower section. The upper container section and the bladder thus collectively establish an interior volume for containing liquid and/or solid materials.

The lower section of the container may be provided with an integral, yet foldable hanger member associated with the lower section's bottom wall. The hanger member is particularly useful to permit inversion of the container of this invention and thus more easily facilitate the emptying of its contents. Thus, the hanger member may be provided in a stowed position such that it is substantially flush against the lower section's bottom wall (thereby presenting no obstacle to the container when it rests upon a flat surface), yet is capable of being folded into an extended position when it is desired to hang or otherwise support the container in an inverted condition.

The bottom of the bladder may also terminate in spaced relation to the bottom wall of the lower container section. In this embodiment of the invention, upper and lower sub-containers are provided in a unitary manner. That is, an upper sub-container is established by means of the interior of the bladder/upper container section, while a lower sub-container is established by means of the space existing between the exterior of the bladder and the interior of the lower container section. Thus, different (or the same) materials may separately fill the upper and lower sub-containers and remain segregated within the overall container. These materials may then be removed separately (as by separating the integral upper container section/bladder from the lower container section, or alternately, may be mixed within the overall container simply by rupturing the bladder.

The bladder-type containers of this invention may optionally be provided with a self-closing liquid dispensing cap, although the dispensing cap disclosed herein is suitable for use with many other types of containers as well.

In one exemplary embodiment in accordance with this invention, the dispenser cap includes a body portion adapted to receive a primary seal member which includes a pair of opposed, flexible and resilient lips defined by an elongated discharge slit formed in an otherwise closed-end flattened, tubular portion of the seal.

The flexible lips, which project upwardly, away from the container contents, are designed to be forced apart when subjected to liquid pressure, as when the container or bottle is tilted in a discharge or dispensing mode, and to automatically close upon the cessation of such pressure, as when the container or bottle is returned to an upright, or storage mode.

The dispensing cap is also provided with an overcap, preferably integrally formed with and hinged to, the body portion of the dispensing cap. The overcap includes a secondary sealing ring which fits snugly inside the primary seal member when the overcap is moved to a closed position, in overlying relationship with the primary sealing member. In addition, the overcap is further provided with a pair of laterally spaced lugs which engage and hold closed the upstanding lips, again when the overcap is moved to a closed position. In this way, egress of liquid is prevented when the overcap is in its closed position, even if the bottle or container is inverted.

In related aspects, the dispenser cap of this invention may be adapted for use as a plug-type or screw thread type closure for use with correspondingly designed containers.

The above described dispenser cap is especially suitable for use with bladder type containers as described herein, as well as other conventional bladder type containers. This is because the vacuum created in the bladder as a result of dispensed liquid not being replaced by air, causes an even tighter engagement and closure of the flexible lips, as will be described in greater detail herein.

Other advantages and aspects of this invention will become more clear to the reader after careful consideration is given to the following detailed description of the preferred exemplary embodiments.

BRIEF DESCRIPTION OF THE DRAWINGS

Reference will hereinafter be made to the accompanying drawings, wherein like reference numerals throughout the various FIGURES denote like structural elements, and wherein;

FIG. 1 is an elevational view, partly in section, of a container in accordance with the present invention;

FIG. 2 is a an "exploded" bottom perspective view of the container shown in FIG. 1;

DETAILED DESCRIPTION OF THE DRAWINGS

Figure 3:
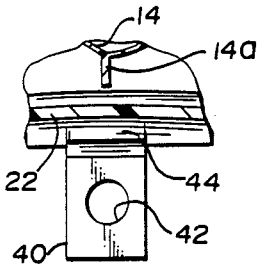
FIG. 3 is a detailed elevational view of the hanger member integrally formed on the bottom wall of the container shown in FIG. 1, and taken along line 3—3 therein.

A container 10 in accordance with this invention is shown in accompanying FIGS. 1 and 2 as generally including a substantially rigid upper container segment 12, a flexible bladder 14 integrally joined to the upper segment 12 at its lower flange 16, and a substantially rigid lower container segment 18. The upper container segment 12 and bladder 14 may be formed of any suitable plastic material (e.g., polyvinylchloride, or polyolefins such as polypropylene and polyethylene). Lower container segment 18, on the other hand may be formed of the same or different plastic material as compared to container segment 12. The lower container segment 18 is defined by a side wall 20 (which in the embodiment shown just happens to be cylindrical in configuration), and a bottom wall 22.

The upper container segment 12, in the embodiment shown, is generally conically shaped, terminating in a neck 24 so as to define an opening to the interior of bladder 14. However, it is to be understood that the upper container segment may be formed in any expedient or desired geometric configuration provided that it extends upwardly from the lower container segment 18 and thus defines a meaningful volume portion of the total volume established by container segment 12/bladder 14. The neck 24, and hence its defined opening, may conveniently be closed by means of a cap 26. The upper container segment 12 also preferably includes opposing depressed regions 28, 30 which collectively serve as handles to more readily facilitate handling and/or other manual manipulations of container 10.

The lower flange 16 of upper container segment 12 is inwardly radially recessed with regard to the upper segment's base periphery 32 so as to permit the flange 16 to be accepted within the upper portion of side wall 20. In such a manner, the container 10 presents, in external appearance, a smooth continuation of surfaces from the side wall 20 of lower container segment 18 to the base periphery 32 of upper container segment 12. Thus, the container segments 12 and 18 visually appear to be unitary with one another. This unitary appearance could be further enhanced by heat or adhesively sealing flange 16 to an opposing interior region of side wall 20. However, in the embodiment shown, the flange 16 is provided with threads 34 so as to mate with corresponding threads 36 on the upper region of side wall 20 and thus permit the upper container segment 12 to be removably coupled to lower container segment 18.

As is seen particularly in FIG. 1, the upper container segment 12 defines a meaningful portion (e.g., about one-fourth or more) of the total volume collectively defined by the upper segment 12 and its integral bladder 14. That is, since the upper segment 12 extends upwardly from its flange 16 (and hence its interconnection with the lower container segment 18), an additional volume of container capacity is provided as compared to containers which merely define an access opening by means of a thickened section associated with a flexible bladder. And, since a smooth continuity exists between the lower and upper segments, a container which is "unitary" in appearance is achieved as has been mentioned previously.

The bladder 14, as was briefly mentioned, is connected integrally to the rigid upper container segment 12 at flange 16. Thus, although the segment 12 and bladder 14 are formed of the same plastic material, their respective rigidity and flexibility is provided by the relative thickness of these structural elements. That is, the thickness of bladder 14 is such that it exhibits sufficient flexibility while the upper container segment 12 is several times as thick as bladder 14 and hence exhibits sufficient rigidity.

The integral upper container segment 12 and bladder 14 may be formed by any convenient plastic formation technique well known to those in this art. Preferably, the integral container segment 12/bladder 14 is formed according to the blow-molding techniques disclosed in co-pending U.S. application Ser. No. 008,658 filed Jan. 30, 1987 in the name of Edward S. Robbins, III (the entire content of this pending application being expressly incorporated herein by reference). The bladder 14 will be sealed at its lower end 14*a* (as by means of heat sealing or the like) so that the interior volume established collectively by the upper container segment 12 and the bladder 14 is accessible only through the opening defined by neck 24.

The bottom wall 22 of lower container segment 18 is preferably slightly concave and includes a substantially centrally located integral hanger member 40. Hanger member 40 is normally stowed in a flush relationship against the bottom wall 22 (i.e., as is shown in dashed and solid lines in FIGS. 1 and 2, respectively), yet is capable of being folded (i.e., pivoted) into an extended position (as is shown in solid line in FIG. 1 and is more clearly shown in that position in FIG. 3) to facilitate supported inversion of container 10. In this regard, an aperture 42 may be defined in hanger member 40 so as to permit the container 10 to be supported in an inverted condition. Folding of hanger member 40 between its stowed and extended positions is enhanced by providing a region 44 of reduced cross-sectional thickness and thereby to provide an integral hinge with bottom wall 22.

Vent openings 46 may be defined in side wall 20 of lower container 10 as is shown in dashed line in FIGS. 1 and 2 so as to permit ambient air to enter the space defined between the bladder 14 and the lower container segment 18. Vents may also be provided by means of an interrupted thread arrangement on flange 16 and the upper region of lower container 18. Venting of ambient air into the lower container 18 thus permits the bladder 14 to be collapsed more easily when its contents are being emptied.

Figure 4:
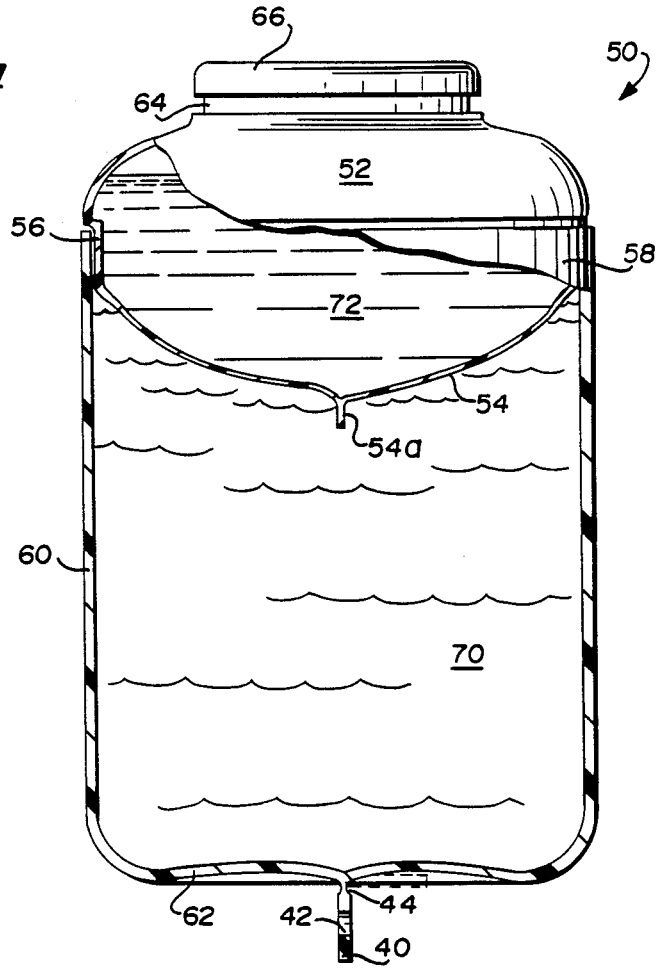
FIG. 4 is a elevational view, partly in cross-section of another container embodiment of this invention which is particularly adapted to provide separate sub-chambers therein.

FIG. 4 shows another embodiment of a container 50 according to this invention. Like container 10 discussed above with particular reference to FIGS. 1 and 2, container 50 of the embodiment shown in FIG. 4 includes a rigid upper container segment 52 (which, it will be noted, is of different geometric configuration as compared to the upper segment 12 of container 10 shown in FIGS. 1 and 2), a bladder 54 integrally connected to segment 52 at flange 56, and a lower rigid container segment 58. Flange 56 of container 50 is coupled to the interior region of side wall 60 of lower container segment 58 by means of heat sealing adhesive, or the like. Of course, threaded coupling between flange 56 and side wall 60 could be provided in a manner similar to that provided in container 10 shown in FIGS. 1 and 2. The bottom wall 62 of container 50 is likewise slightly concave and includes an integral hanger member 40. The upper container segment 52 also includes a neck region 64 which defines an opening covered by cap 66. (It will be noted that the diameter of neck 64 of container 50 is larger as compared to the diameter of neck 24 of container 10 and thus exemplifies that any dimensional and/or geometric configuration may be provided according to the invention so as to obtain access to the interior of the containers 10 and 50.)

The bottom 54*a* of bladder 54 is spaced from the bottom wall 62 of lower container segment 58 so as to establish a lower sub-container 70 therebetween in which liquid and/or solid material may be contained. The integral bladder 54 and upper container segment 52, on the other hand, collectively establish an upper sub-container 72 so as to contain another (or the same) liquid and/or solid therein. Thus, the material filling sub-containers 70 and 72 may be transported and stored in a segregated manner but may be mixed internally within the container 50 at the point of use simply by rupturing the bladder 54. That is, when it is desired to mix the material contents of sub-containers 70 and 72, a user may insert a sharp implement through opened neck 64 and thus puncture the bladder 54. Thereafter, the cap 66 may be replaced and the container 50 shaken so as to ensure adequate material mixing. Of course, the contents of sub-containers 70 and 72 may be used separately, in which case, it is preferred that the upper container segment 52 be provided with threads or like means so that it is removably coupled to the lower container segment 58.

When preparing the container 50 for use as a unitary mixing means for two materials, one of the materials will first be introduced into the lower container segment 58. That is, a predetermined volume of material is introduced into container segment 58 so that the material occupies the lower sub-container 72 when the upper and lower container segments are coupled to one another. The other material may then be introduced into the upper sub-container 70 (either before or after the upper and lower container segments 12, 18, respectively are coupled to one another) and the cap 66 is placed over neck 64. Thereafter, point-of-use mixture of the two materials in sub-containers 70 and 72 may be accomplished in the manner described above.

The embodiment of container 50 shown in FIG. 4 is thus advantageous to, for example, allow transport, storage and point-of-use mixture for two dissimilar liquids, a liquid and a solid, or two dissimilar solids, for example. This feature may be useful to prolong the useful life of a chemical mixture, for example, or to provide chemical reaction between the contents of sub-containers 70 and 72 at the point of use. And, container 50 may also be used to transport food stuffs, for example, a cereal and a liquid dairy product, so that they may be mixed just prior to consumption.

With reference now to FIGS. 5 through 10, a dispensing cap in accordance with this continuation-in-part application is illustrated. A beverage container, and in an exemplary embodiment a wine bottle 74, includes a substantially rigid upper segment 76, a flexible bladder as described hereinabove, but not shown in FIG. 5, and a substantially rigid lower segment 78. The upper and lower segments 76, 78 and bladder are preferably constructed of materials as disclosed hereinabove with respect to the container illustrated in FIGS. 1—4.

In addition, the bottle 74 tapers to a neck 80 which defines an opening which is engaged by a dispensing cap 82.

Figure 5:
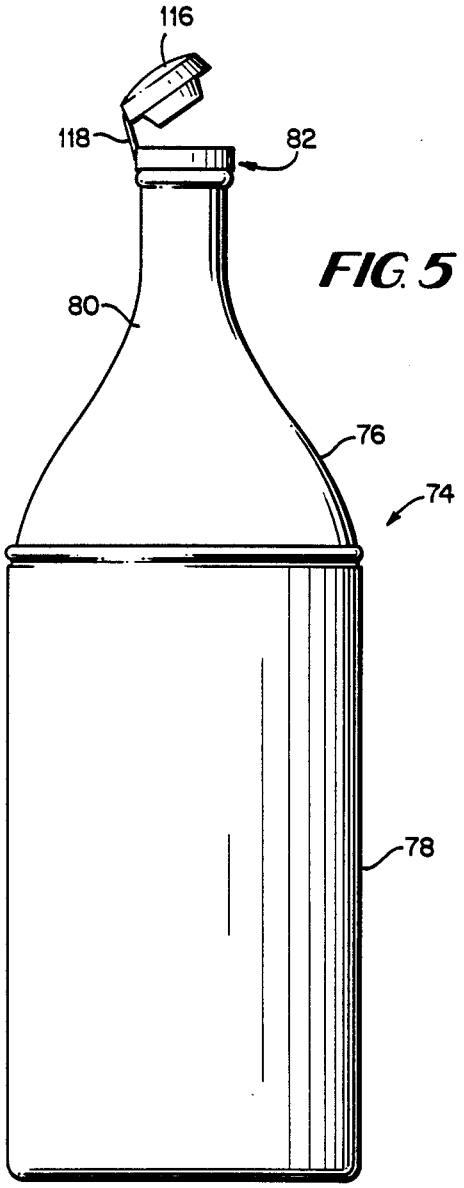
FIG. 5 is a side view of a combined beverage bottle and dispenser cap in accordance with a further exemplary embodiment of the invention, the dispenser cap being of the plug type.

The cap 82 includes a hollow, generally cylindrical body portion 84, an upper, radially outwardly directed flange portion 86. It will be understood that the body portion which in FIG. 5 is shown as a plug-type closure, may be tapered slightly at its end remote from the flange portion 86 to facilitate insertion of the plug within the bottle opening. In addition, the body portion maybe provided with axially spaced annular ribs 88 which provide tight frictional engagement with the interior surface of the bottle neck.

The dispensing cap is provided with a through passageway 90 (FIGS. 8 and 9) extending through the body portion and upper radial flange portion. In that area of passageway which is generally adjacent the upper radial flange, there may be provided one or more annular grooves 92 for a purpose to be explained below.

In addition, the through-passageway 90 terminates at an annular shoulder 94 which is located just below a substantially flat top surface 96 of the flange portion 86.

Figure 8:
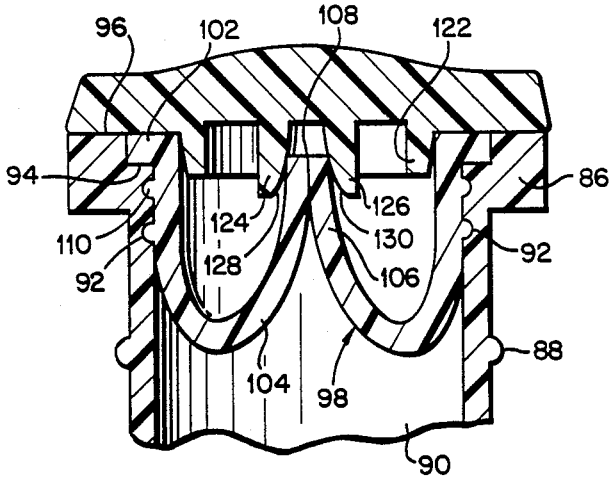
FIG. 8 is a partial cross-sectional view of the dispenser cap illustrated in FIG. 7.
Figure 9:
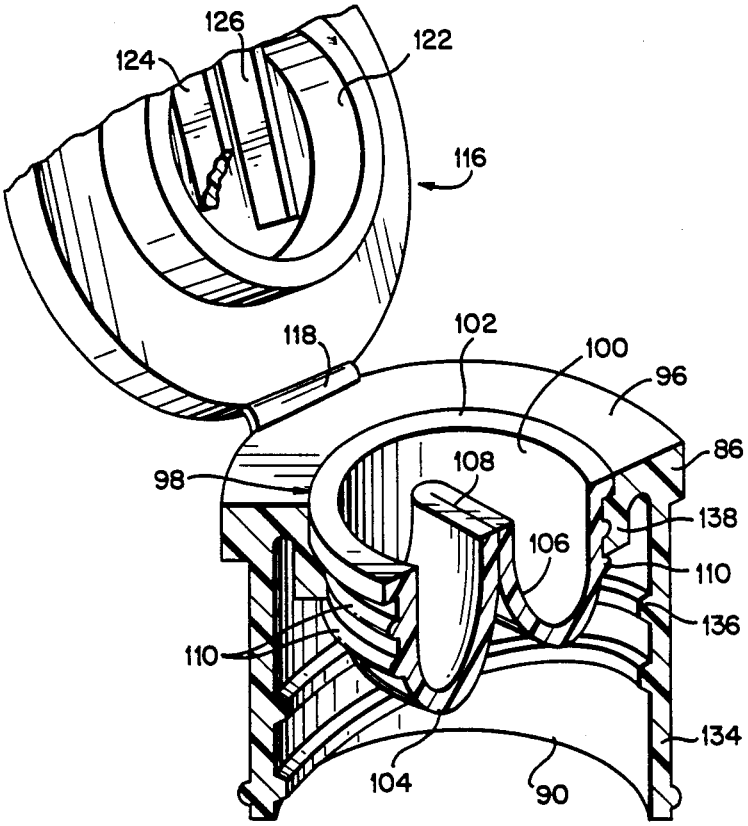
FIG. 9 is a partial perspective view and partial section of a screw-on type self-closing dispenser cap as illustrated in FIG. 6.

As best seen in FIGS. 8 and 9, a primary seal member 98 is received within the through passageway 90. More specifically, the primary seal member 98 is generally cup-shaped and includes an annular skirt or wall 100 which terminates at an upper, radially outwardly directed flange 102, and which is doubled back on itself at its lower end 104 to form an upwardly directed, flattened tubular portion 106 which is provided with a longitudinally extending slit 108 which forms the dispenser cap discharge opening.

The annular skirt or wall 100 is provided on its exterior surface with one or more axially spaced, annular ribs 110 which are designed to fit within one or more of the above described annular grooves 92.

In addition, the radially outwardly directed flange 102 is sized to seat on the annular shoulder 94 when the primary seal is pressed into the through passageway 90. In its fully inserted position, the flange 102 of the primary seal lies flush with the top surface 96.

Figure 10:
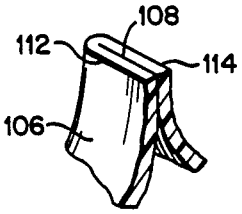
FIG. 10 is a partial detail illustrating a primary sealing member of the dispenser cap in a closed position.
Figure 11:
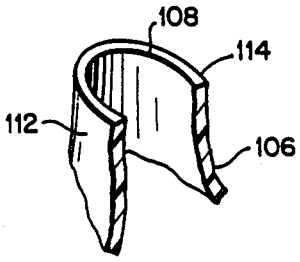
FIG. 11 is a partial detail illustrating a primary sealing member of the dispenser cap in a open position.

By slitting the flattened tubular portion 106, a pair of opposed lips 112, 114 are formed on either side of the slit 108. It will be understood that during normal circumstances, the resilient and flexible lips 112, 114 are biased into a normally closed position, as best seen in FIG. 10.

However, in use, i.e., when the bottle is tilted in the normal course of discharging liquid therefrom, the flow of liquid will force the lips 112, 114 to separate, thereby permitting flow through the primary seal as best seen in FIG. 12. When the bottle is returned to its upright position, the lips 112, 114 assume their normally closed position.

It is to be noted in this regard that the primary seal 98 is comprised of a flexible, resilient material such as a thermoplastic elastomer or rubber. The remainder of the dispensing cap is constructed of a more rigid plastic material, such as a polyolefin.

An overcap 116 is provided, and is preferably integrally molded with the dispensing cap so as to be pivotally attached thereto by an integral hinge 118. It will be understood, of course, that the overcap 116 may be separately manufactured and nevertheless useable with the dispensing cap exactly as described hereinbelow.

The undersurface 120 of the overcap 116 is provided with an annular skirt or ring 122 which is adapted to fit snugly within the primary seal member 98 when pivoted to a closed position best seen in FIG. 8. Thus, the skirt or ring 122 serves as a secondary seal, preventing any liquid which may have escaped through the slit 108 from also escaping the dispenser cap.

In addition, undersurface 120 is provided with a pair of adjacent lugs 124, 126 which are spaced apart a distance corresponding substantially to the combined thickness of lips 112, 114. The lugs are tapered at their free ends 128, 130 so as to guide the lips between the lugs as the overcap is closed. In this regard, the lugs may be spaced apart a distance slightly less than the combined thickness of the lips so that, upon closing, the lips are lightly compressed. Thus, a third sealing means is provided which insures that no liquid will escape the container even when the container is inverted, so long as the ring 122 is snugly fitted within the primary seal member 98, i.e., when the overcap 116 is in its closed position.

Figure 6:
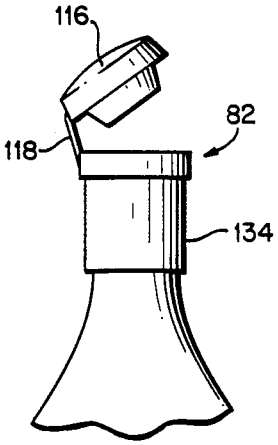
FIG. 6 is a partial side view of the combination illustrated in FIG. 5, but wherein the cap is of the screw-on type.
Figure 7:
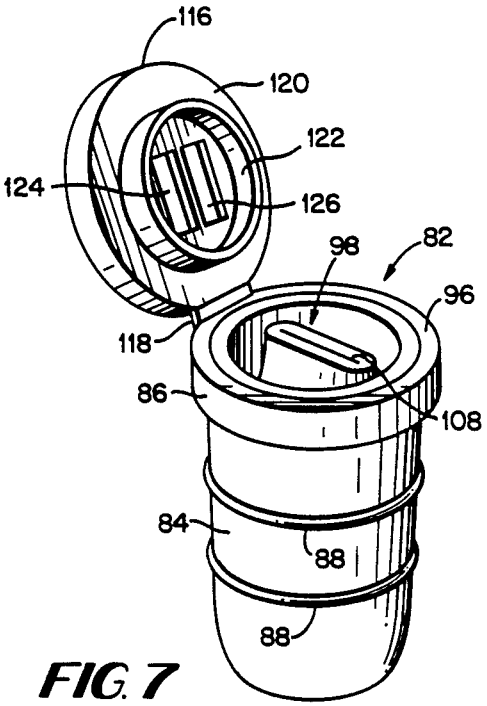
FIG. 7 is a perspective view of a plug-type self-closing dispenser cap as illustrated in FIG. 5.

In a further aspect of the invention, the dispenser cap may be adapted for attachment to screw thread-type containers. Thus, as illustrated in FIGS. 6 and 9, the cap 132 has a body portion which includes an outer, depending, annular skirt 134 which is provided with a screw thread 136 about its interior surface for mating engagement with conventional threads provided on the container neck. In addition, a relatively shorter, interior, annular skirt 138 is provided for receiving the primary seal member 98 in the same manner as described hereinabove.

It will be understood that the above-described dispenser cap may be sized for use with virtually any liquid dispensing container to provide effective and automatic closing of the dispensing aperture or opening upon the container assuming an upright position. However, when utilized with a bladder-type container as herein described, or with conventional bladder-type containers, even more effective sealing action is obtained. This is because of the vacuum created within the bladder when liquid is dispensed therefrom, but is not replaced by air as the bottle is returned to an upright position. The vacuum thus tends to collapse the bladder, while at the same time, drawing the lips 112, 114 downwardly and inwardly into tight, sealing engagement with each other. As a result, the dispenser cap of this invention provides in one exemplary embodiment, three structural sealing means in combination with an additional vacuum seal, thereby effectively preventing egress of liquid and ingress of air, thereby also insuring prolonged freshness of the container contents. This, of course, is especially desirable in the case of wine and other potable liquids.

Thus, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A container comprising:

a rigid upper container segment which establishes one portion of a total volumetric capacity for the container;

a rigid lower container segment;

means for coupling said upper and lower container segments one to another; and a flexible bladder which establishes a remaining portion of the total volumetric container capacity so that said upper container segment and said bladder collectively establish said total volumetric container capacity, said bladder being integrally formed with said upper container segment such that said bladder depends from said upper container segment and is housed within said lower container segment, wherein said upper container segment also defines an access opening to permit access to contents within said upper container segment and bladder; and wherein a dispenser cap is removably attached to said upper container segment overlying said access opening, said dispenser cap including a self-closing dispensing aperture.

2. A container as in claim 1, wherein said upper container segment defines an external base peripheral surface, and includes an annular flange inwardly radially recessed With respect to said base surface so that said flange is accepted within an upper region of said lower container segment.

3. A container as in claim 2, wherein said upper container segment is substantially conically shaped.

4. A container as in claim 3, wherein said upper container segment includes a neck region extending upwardly from said upper container segment, said access opening being defined by said neck region.

5. A container as in claim 1, wherein said coupling means couples said flange and said upper region of said lower container segment.

6. A container as in claim 1 wherein said self-closing aperture is provided in a first sealing member and comprises a first sealing means, and wherein an overcap is provided which includes second and third sealing means.

7. A container as in claim 6 wherein said first sealing member comprises an upwardly extending, flattened tubular portion, and wherein said dispensing aperture is formed by an elongated slit at an upper end of said tubular portion, said slit and said flattened tubular portion defining a pair of resilient, flexible lips.

8. A container as in claim 6 wherein said overcap is hinged to said cap for movement between open and closed positions, an underside of said overcap having a depending annular skirt portion comprising said second sealing means, said skirt portion engageable with said first sealing member when said overcap is in the closed position.

9. A container as in claim 6 wherein said first sealing member is constructed of a relatively flexible thermoplastic elastomer or rubber, and remaining cap portions including said overcap are constructed of a relatively rigid polyolefin.

10. A container and dispensing cap assembly for liquid contents comprising:

a container body having a closed end and an open end;

a dispenser cap removably attached to said container body at said open end, said dispenser cap including a body portion having first sealing means which comprises a cup-shaped member removably secured within said body portion and including a flexible, resilient member having a flattened tubular portion in which a self-closing aperture is provided in the form of an elongated slit, said flattened tubular member extending upwardly from a lower end of said cup-shaped member; and an overcap hinged to said body portion for movement between open and closed positions, said overcap including second and third sealing means for engaging said first sealing means when said overcap is in the closed position.

11. A container and dispensing cap assembly as in claim 10 wherein said second sealing means comprises an annular skirt portion on an underside of said overcap.

12. A container and dispensing cap assembly as defined in claim 10 wherein said container body includes a flexible bladder for holding said liquid contents.

13. A container and dispensing cap assembly as defined in claim 12 wherein said flexible bladder is formed integrally with said container body.

14. A container and dispensing cap assembly as in claim 1 wherein said flattened tubular portion extends away from said closed end and wherein said slit and said flattened tubular portion define a pair of opposed, flexible lips which are adapted to open under fluid pressure to permit dispensing of said contents and to automatically close upon cessation of the fluid pressure.

15. A container and dispensing cap assembly as defined in claim 14 wherein said third sealing means comprises a pair or elongated lug members on an underside of said overcap.

16. A container and dispensing cap assembly as defined in claim 15 wherein said lug members engage said lips on either side thereof when said overcap is in said closed position.

17. A container and dispensing cap assembly as defined in claim 16 wherein said lug members are provided with tapered surfaces which cam said lips into tight sealing engagement.

18. A container and dispensing cap assembly for storing and dispensing fluid contents, said container comprising a rigid upper portion provided with a neck; a body portion integrally formed with said upper portion and comprising a flexible bladder adapted to hold said contents; and a lower rigid portion vented to permit exposure of said bladder to atmospheric pressure, said bladder preventing discharged fluid contents from being replaced by air, thereby creating at least a partial vacuum within said bladder, said dispensing cap assembly including a removable cap provided with a dispensing aperture formed by a flattened tubular member having an elongated slit therein, said aperture in use being subjected to said partial vacuum to automatically close said aperture.

19. A dispensing cap for removable attachment to containers of the liquid dispensing type, said cap comprising:

a body portion provided with means for receiving a first sealing member, said first sealing member including a generally cup-shaped portion terminating at an upper end thereof in a radially outwardly directed flange, and a flattened tubular portion extending upwardly from said cup-shaped portion but not beyond said radially outwardly directed flange, wherein said flattened tubular portion is provided with an elongated slit at an upper end thereof to form a pair of opposed, flexible lips which define a dispensing aperture; and wherein said body portion is comprised of a relatively rigid plastic material and said first sealing member is comprised of a relatively soft, flexible plastic material.

20. A dispensing cap as defined in claim 19 wherein said relatively rigid plastic material is a polyolefin.

21. A dispensing cap as defined in claim 19 wherein said relatively soft, flexible plastic material is a thermoplastic elastomer.

22. A dispensing cap as defined in claim 19, wherein said body portion includes a plug portion adapted for friction fit engagement within an open end of a container.

23. A dispensing cap as defined in claim 19, wherein said body portion includes screw threads for engagement with corresponding screw threads provided on an open end of a container.

24. A dispensing cap as defined in claim 19 and wherein said cap further comprises an overcap hinged to said body portion for movement between open and closed positions, wherein, in said closed position, said overcap overlies said first sealing member.

25. A dispensing cap as defined in claim 24, wherein said overcap includes a depending skirt which engages said cup-shaped portion of said first sealing member when the overcap is in said closed position.

26. A dispensing cap as defined in claim 25, wherein said overcap further includes a pair of adjacent, elongated lugs which compress said lips together to seal said aperture when said overcap is said closed position.

27. A container comprising:

a rigid upper container segment which establishes one portion of a total volumetric capacity for the container;

a rigid lower container segment;

means for coupling said upper and lower container segments one to another; and a flexible bladder which establishes a remaining portion of the total volumetric container capacity so that said upper container segment and said bladder collectively establish said total volumetric container capacity, said bladder being integrally formed with said upper container segment such that said bladder depends from said upper container segment and is housed within said lower container segment, wherein said upper container segment also defines an access opening to permit access to contents within said upper container segment and bladder;

a dispenser cap removably attached to said upper container segment overlying said access opening, said dispenser cap including a self-closing dispensing aperture provided in a first sealing member and comprising a first sealing means, and wherein an overcap is provided which includes second and third sealing means, said overcap being hinged to said cap for movement between open and closed positions, an underside of said overcap having a depending annular skirt portion comprising said second sealing means, said skirt portion engageable with said first sealing member when said overcap is in the closed position; and wherein said overcap is further provided with a pair of elongated lugs located radially within said skirt portion and engageable with said first sealing means when said overcap is in the closed position, said lugs comprising said third sealing means.

28. A container and dispensing cap assembly for liquid contents comprising:

a container body having a closed end and an open end;

a dispenser cap removably attached to said container body at said open end, said dispenser cap including a body portion having first sealing means which includes a self-closing aperture in the form of a pair of opposed flexible lips, an overcap hinged to said body portion for movement between open and closed positions, said overcap including second and third sealing means for engaging said first sealing means when said overcap is in the closed position; wherein said third sealing means comprises a pair of elongated lug members on an underside of said overcap which engage said lips on either side thereof when said overcap is in said closed position.

29. A container and dispensing cap assembly as defined in claim 28 wherein said lug members are provided with tapered surfaces which cam said lips into tight sealing engagement.

30. A container and dispensing cap assembly as defined in claim 28 wherein said container body includes a flexible bladder for holding said liquid contents.

31. A dispensing cap for removable attachment to containers of the liquid dispensing type, said cap comprising:

a body portion provided with means for receiving a first sealing member, said first sealing member including a generally cup-shaped portion and a flattened tubular portion extending upwardly from said cup-shaped portion, wherein said flattened tubular portion is provided with an elongated slit at an upper end thereof to form a pair of opposed, flexible lips which define a dispensing aperture; and wherein said body portion is comprised of a relatively rigid plastic material and said first sealing member is comprised of a relatively soft, flexible plastic material;

said cap further comprising an overcap hinged to said body portion for movement between open and closed positions, wherein, in said closed position, said overcap overlies said first sealing member, said overcap including a depending skirt which engages said cup-shaped portion of said first sealing member, and a pair of adjacent, elongated lugs which compress said lips together to seal said aperture when said overcap is in said closed position.

32. A container and dispensing cap assembly as defined in claim 12 wherein said flexible bladder is formed integrally with said container body.

* * * * *